US008267676B2

(12) United States Patent
Skofteland et al.

(10) Patent No.: US 8,267,676 B2
(45) Date of Patent: Sep. 18, 2012

(54) APPARATUS AND METHOD FOR PREVENTING THE PENETRATION OF SEAWATER INTO A COMPRESSOR MODULE DURING LOWERING TO OR RETRIEVAL FROM THE SEABED

(75) Inventors: Håkon Skofteland, Jar (NO); Kjell Olav Stinessen, Oslo (NO); Audun Grynning, Stabekk (NO); Øyvind Rokne, Vøyenenga (NO)

(73) Assignee: Aker Subsea AS, Fornebu (NO)

( * ) Notice: Subject to any disclaimer, the term of this patent is extended or adjusted under 35 U.S.C. 154(b) by 649 days.

(21) Appl. No.: 12/307,046

(22) PCT Filed: Jun. 20, 2007

(86) PCT No.: PCT/NO2007/000221

§ 371 (c)(1),
(2), (4) Date: May 20, 2009

(87) PCT Pub. No.: WO2008/002147

PCT Pub. Date: Jan. 3, 2008

(65) Prior Publication Data

US 2009/0266553 A1 Oct. 29, 2009

(30) Foreign Application Priority Data

Jun. 30, 2006 (NO) ..... 20063043

(51) Int. Cl.
*F04B 35/04* (2006.01)

(52) U.S. Cl. ..... 417/423.3

(58) Field of Classification Search ..... 417/6, 26, 417/34, 53, 313, 360, 423.3, 434, 435
See application file for complete search history.

(56) References Cited

U.S. PATENT DOCUMENTS 5,382,141 A 1/1995 Stinessen
6,086,331 A 7/2000 Halkjaer
2006/0157251 A1 7/2006 Stinessen et al.

FOREIGN PATENT DOCUMENTS

| | | |
|---|---|---|
| JP | 58-051296 A | 3/1983 |
| NO | 310317 B1 | 12/1997 |
| WO | 92/14061 | 8/1992 |
| WO | 2005/003512 | 1/2005 |
| WO | 2007/043889 | 4/2007 |

OTHER PUBLICATIONS

International Search Report dated Oct. 29, 2007, from corresponding PCT application.

*Primary Examiner* — Anh Mai
*Assistant Examiner* — Andrew Coughlin
(74) *Attorney, Agent, or Firm* — Young & Thompson

(57) ABSTRACT

An apparatus for preventing seawater from penetrating into a compressor module during lowering to or retrieval from a compression plant on the seabed, with optional discharge of residual production fluids, as for instance hydrocarbons, from the compressor module prior to retrieval, wherein the compressor module comprises an electric motor (1) and a compressor (2) which are respectively connected via at least one shaft (8) and are arranged in a common pressure shell (3), an inlet pipe (5) and an outlet pipe (6) to and from the compressor module which respectively are provided with an isolation valve (7, 7'). The compressor module is distinguished in that it includes at least one filling pipe (16) which has a shut-off valve (15), at least one drainage pipe (12) which has a shut-off valve (13), and which is located at a lower end of the compressor module, and at least one overflow pipe (14) which has a shut-off valve (17), and which is spaced apart from the at least one filling pipe (16), and that prior to lowering to or retrieval from the seabed, with optional discharge of residual production fluids prior to retrieval, the compressor module is filled with filling fluid via the at least one filling pipe (16) until overflow of filling fluid through the at least one overflow pipe (14). The present invention also relates to a method which correspondingly prevents such penetration of seawater into and discharge of residual production fluid from the compressor module.

22 Claims, 1 Drawing Sheet

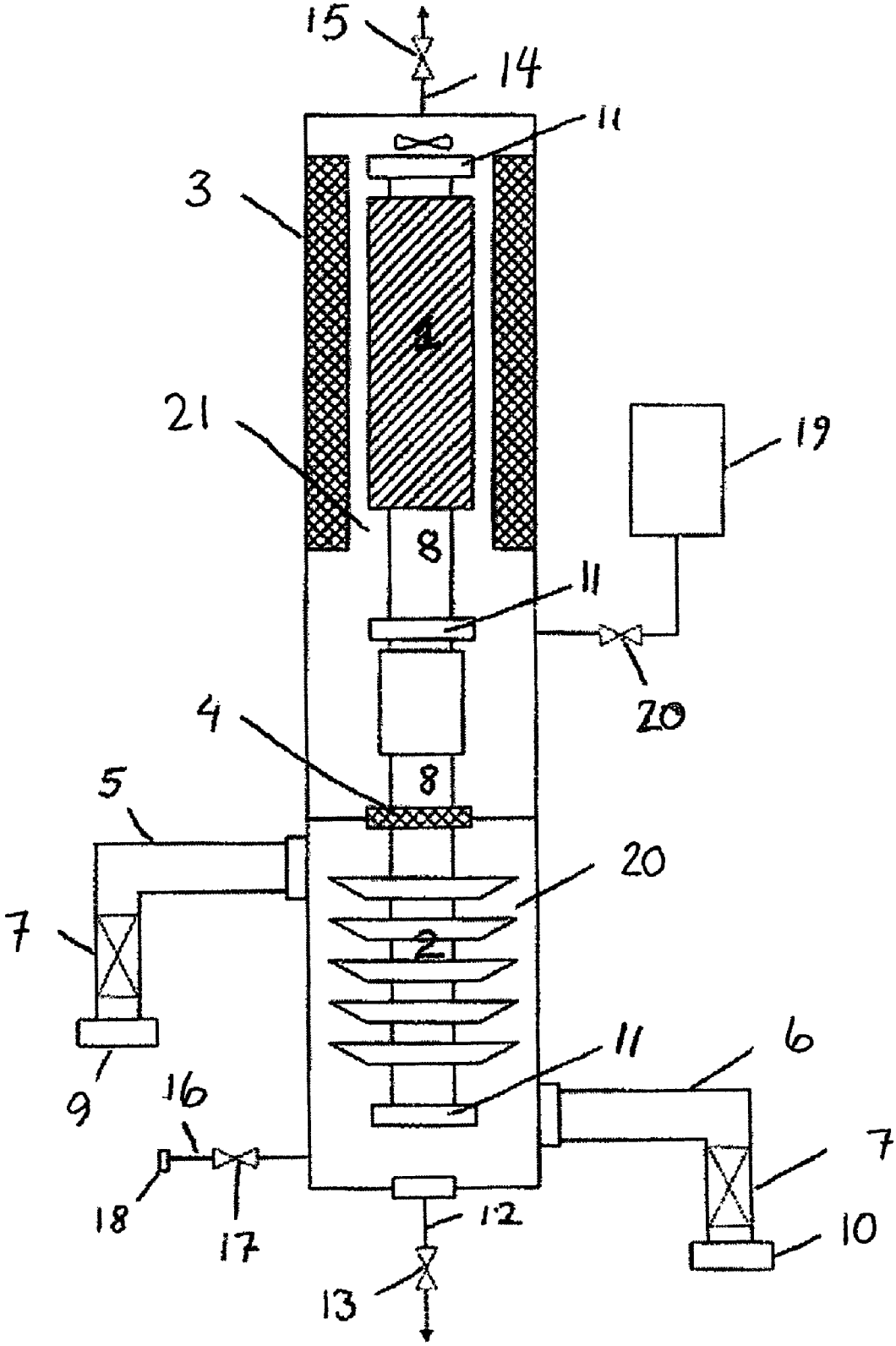
15
14
11
3
1
21
19
8
11
20
4
8
5
20
7
2
11
6
9
16
7
18
17
12
10
13

APPARATUS AND METHOD FOR PREVENTING THE PENETRATION OF SEAWATER INTO A COMPRESSOR MODULE DURING LOWERING TO OR RETRIEVAL FROM THE SEABED

The invention relates to how seawater is prevented from penetrating into a subsea compressor module during lowering to or retrieval from the seabed prior to connection to or disconnection from a compression plant on the seabed, with optional discharge of remaining production fluid from the compressor module prior to retrieval. Furthermore, this also means that an amount of seawater which has entered the compressor module during installation despite appropriate measures can be drained out of the compressor module after installation at the compressor plant and before start-up of operations.

The compressor itself may be contaminated or completely filled with seawater without this necessarily having adverse consequences. However, the motor operating the compressor is more vulnerable. Of course, the motor can be drained and dried before application of full voltage and start-up, but a small residue of precipitated salts and other contaminants could, during operation, cause problems in the form of corrosion and in the worse case short-circuit, and in particular if this residue should be condensed as water inside the motor during different forms of operation or during shutdown.

However, it should be pointed out that even a motor of standard design, i.e., not of the encapsulated or canned type, and which is specially engineered for use in subsea compressors, i.e., where both stator and rotor are protected by a coating of a specifically adapted quality, is claimed to withstand complete filling with seawater during installation, without this resulting in problems during operation. In the present invention, therefore, the principle of fluid filling of the compressor module is included as a possibility during installation as such.

Clearly, it is advantageous to eliminate uncertainty by taking steps to ensure that seawater is prevented from penetrating into the compressor module during lowering and connection to and subsequent disconnection and retrieval from a subsea compressor station. Furthermore, it is also important that the same compressor module does not contain dangerous concentrations of production fluids, as for instance hydrocarbons, in excess of permitted concentrations prescribed in the relevant regulations, when it is disconnected from the compression station on the seabed and similarly that seawater is kept out of the unit when it is retrieved and hoisted up onto the deck of a vessel. Accordingly, the present invention is primarily directed to these conditions.

The reason that a subsea compressor is disconnected and retrieved may, for example, be for routine inspection and maintenance, or after a breakdown. By the expression "dangerous concentrations of hydrocarbons" in connection with the retrieval of such a unit is meant first and foremost concentrations which may involve a danger of explosion when the unit is opened, but undesirable mud and contamination as well as possible corrosion are also taken into account.

The invention is specifically directed to subsea compressor modules for compressing hydrocarbon gases in a wellstream, and more specifically to a compressor module which comprises a pressure housing, a compressor and a motor. Normally, there will be a sealing element between the motor and compressor. The motor and the compressor both have magnetic bearings which may be of standard design or of the encapsulated or canned type.

Such subsea compressor modules are referred to in, for example, NO Patent Application 20054620 and in WO Patent Application 2005/003512.

A subsea compressor module in its most basic form is a unit in which a compressor and a motor are connected via at least one shaft and placed in a common pressure shell. However, in the case of the present invention it is irrelevant whether the motor and the compressor are mounted on a common rigid shaft or have separate shafts connected by a rigid coupling, or whether there is a flexible coupling between the motor shaft and compressor shaft. Between the motor and the compressor there is, in the case of motors of standard design, at least one seal to prevent contamination of the motor from the compressor compartment itself. During operation, there may be problems in keeping the gas-filled, electric motor as dry as necessary to avoid corrosion and other problems associated with condensation of hydrocarbon condensates and water in liquid form inside the motor. It is especially important to avoid the presence of water in liquid form together with an $H_2S$ or $CO_2$ content, which may lead to acid formation and consequently give rise to accelerated corrosion. These problems are examined more closely in NO Patent 172075 and 173197 and also in NO Patent Application 20054620 and WO Patent Application 2005/003512. It is also important to prevent particles from penetrating into and accumulating to a harmful level inside the motor and magnetic bearings during operation.

If the motor is of the canned type, the stator in the motor is hermetically separated from the rest of the motor compartment by an inner cylinder that can be made of metal or a synthetic material. Canned motors can therefore be operated with the contaminants mentioned above inside without the stator being damaged. When only this is taken into account, there is therefore, in principle, no need for sealing between the compressor and motor compartments. To protect the rotor and the other internal components of a canned motor and to prevent the build-up over time of unacceptable amounts of sand particles or salts, there is reason to believe that in fact a seal between the compressor and motor compartments is advantageous or necessary in the case of canned motors, and that there are thus provided arrangements which prevent contaminants from flowing through the seal from the compressor compartment into the motor compartment during operation.

To protect the rotor and other internal components of a canned motor, there is a need for protection during lowering and retrieval, such as in accordance with the present invention.

As regards the present invention, which thus relates to the lowering and connection of a subsea compressor and also to the disconnection and retrieval of the same, it is irrelevant whether or not there is a seal between the compressor and the motor.

It should also be stressed that when the terms subsea compressor, compressor module, compressor or unit are used in this text, they may also comprise multi-phase pumps with gas-filled motors and magnetic bearings, and also liquid pumps with gas-filled motor where the motor, but not necessarily the pump, has magnetic bearings.

For reasons that have been mentioned above, there is a need to prevent seawater from penetrating into a subsea compressor module during its lowering into the sea for connection to a compressor station under water. It is also desirable to have a solution that does not result in, inter alia, hydrocarbons being carried along in the compressor module and seawater subsequently penetrating into the same during retrieval to an installation vessel.

Therefore in accordance with a first aspect of the present invention, there is provided an apparatus for preventing seawater from penetrating into a compressor module during lowering to or retrieval from a compression plant on the seabed, with optional discharge of residual production fluids, as for instance hydrocarbons, from the compressor module prior to retrieval, wherein the compressor module comprises an electric motor and a compressor which are respectively connected via at least one shaft and are arranged in a common pressure shell, an inlet pipe and an outlet pipe to and from the compressor module which respectively are provided with an isolation valve, characterised in that the compressor module is equipped with at least one filling pipe which has a shut-off valve, at least one drainage pipe which has a shut-off valve, and which is located at a lower end of the compressor module, and at least one overflow pipe which has a shut-off valve, and which is spaced apart from the at least one filling pipe, and that prior to lowering to or retrieval from the seabed, with optional discharge of residual production fluids prior to retrieval, the compressor module is filled with filling fluid via the at least one filling pipe until overflow of fluid through the at least one overflow pipe.

In accordance with a second aspect of the invention there is provided a method for preventing seawater from penetrating into a compressor module during lowering to or retrieval from a compression plant on the seabed, with optional discharge of residual production fluids, as for instance hydrocarbons, from the compressor module prior to retrieval, wherein the compressor module comprises an electric motor and a compressor which are respectively connected via at least one shaft and are arranged in a common pressure shell, an inlet pipe and an outlet pipe to and from the compressor module which respectively are provided with an isolation valve, characterised in equipping the compressor module with at least one filling pipe which has a shut-off valve, at least one drainage pipe which has a shut-off valve, and which is located at a lower end of the compressor module, and at least one overflow pipe which has a shut-off valve and which is spaced apart from the at least one filling pipe, and that prior to lowering to or retrieval from the seabed, with optional discharge of residual production fluids prior to retrieval, filling the compressor module with filling fluid via the at least one filling pipe until overflow of fluid through the at least one overflow pipe.

It is pointed out that the filling fluid may be selected in the form of a gas, such as nitrogen or another gas that is inert in relation to the interior of the compressor module, or a liquid such as deionised water or MEG and mixtures thereof or another liquid that is inert in relation to the interior of the compressor module. Otherwise, advantageous embodiments of the invention are set forth in the dependent claims.

The conditions for positioning filling pipes, drainage pipes and overflow pipes in order efficiently to ensure removal of any air before lowering, of seawater before start-up and hydrocarbons before retrieval are, as will be understood, somewhat different depending on whether the filling fluid is a liquid or a gas.

In the instances that the filling fluid is a liquid, optimal positioning is in practice ensured by the at least one overflow pipe being positioned at high points in the module so as to prevent the occurrence of gas pockets. The at least one filling pipe is then positioned as low as possible so that the liquid is filled upwards, with the effect that the liquid, like a piston, presses any gas out via the overflow. The at least one drainage pipe is however positioned at low points to prevent pools of unwanted accumulated liquid such as seawater or liquid hydrocarbon from remaining in the compressor module.

When the fluid is a gas, the positioning of the filling and overflow pipes is not so critical, except that they ought to be positioned at a certain distance from each other. This prevents a short-circuit flow of gas which effectively counteracts dilution of hydrocarbon gas in the module. A known way of efficiently diluting air in a pressure tank to a non-hazardous level as regards risk of explosion, i.e., permitted level, before hydrocarbon gas is passed into the tank and a corresponding dilution of hydrocarbon gas in the tank before air is let in, as for instance in connection with maintenance, is to pressure the tank up with nitrogen or other inert gas and then depressurise to atmospheric pressure a number of successive times The same can be done with the compressor module to remove air prior to lowering and installation. By using inert gas filling before retrieval, a similar procedure can be employed, for example, repeated pressuring up to the compressor outflow pressure or, at the maximum, to wellhead shutdown pressure, which is what the unit is designed for, and depressurisation to compressor inlet pressure, that is to say the lowest pressure it can be depressurised to in the compression station when it is installed under water. For the sake of simplicity, such procedures for obtaining acceptable, low concentrations are called "flushing" in what follows.

For the record, it should be pointed out that the filling fluid primarily, but not exclusively, is either inert liquid or inert gas. Furthermore, "overflow" means both overflow of inert liquid at at least one high point on the compressor module and discharge of inert gas through at least one overflow pipe which is not necessarily positioned at a high point.

The invention will now be explained in more detail by means of a preferred embodiment which is shown in the attached drawing, wherein:

FIG. 1 is a schematic diagram of an apparatus according to the present invention.

The compressor module comprises an electric motor 1 and a compressor 2 interconnected via at least one shaft 8 and arranged in a common pressure shell 3. As already mentioned above, the shaft may consist of any suitable shaft type. At least one axial seal 4 is disposed between the compressor 2 and the motor 1, and divides the pressure shell into a motor compartment 21 and a compressor compartment 20. It is understood that when using a canned motor, the seal may be omitted. Otherwise, it is obvious that the pressure shell can have other compartments than the two shown in the drawing. The shaft 8 is, for example, supported by means of magnetic bearings 11. The number and location of the magnetic bearings may differ from what is illustrated.

Furthermore, the compressor module has an inlet pipe 5 and an outlet pipe 6. Each inlet and outlet pipe has an isolation valve 7, 7', and is provided with a connector 9, 10 for connection to a subsea compression station, not shown in the drawing. In the lower part there is at least one drainage pipe 12 with a shut-off valve 13. At the top of the module there is provided at least one pipe 14 with shut-off valve 15. Thus, the pipe 14 can form an overflow for the filling fluid that is used for filling the motor before lowering and retrieval. As pointed out above, the pipe 14 need not necessarily be positioned at the top of the module. The pipes 12, 14, which both have non-illustrated connectors, convey the filling fluid to a suitable point in the compression station, for example, to a separator or a scrubber, not shown in the drawing, upstream of the compressor module.

In the event that nitrogen overpressure, or for that matter any overpressure provided by an inert gas, is to be used in the compressor module, the pipe 14 is used for flushing with filling gas and as "vent pipe" when the module is to be drained prior to retrieval.

Due to the friction loss and hence the heat generation in the motor 1 which must be removed during operation, the motor is cooled, for example, by heat exchange to the surrounding seawater in a heat exchanger which will constitute a part of the compressor module volume, not shown in the drawing. For the filling/flushing with inert fluid, the cooler forms a part of the motor compartment.

Furthermore, the pressure shell 3 is equipped with at least one pipe 16 which has a shut-off valve 17 and a connection point 18. When the compressor module has been filled with filling fluid in the form of a suitable inert liquid during lowering and retrieval, a pressure/volume compensator 19 can, if required, be connected to the module. This means that the compensator 19 may, in addition, in a known way also have an overpressure function, so that the pressure in the filling liquid is adjusted to a suitable overpressure relative to the surrounding seawater pressure. In many cases such pressure/volume compensation is not required, as the pressure housing of the motor and compressor withstands the pressure variations that occur during installation and retrieval due to variation in the external seawater pressure, varying temperature and different expansion coefficients of the inert fluid and the metal of the pressure housing.

It is pointed out that the pipes 12, 14, 16, of which only one of each is shown in the drawing, can be positioned at suitable points in order to obtain optimal filling, flushing and draining. As already mentioned, the positioning depends upon whether filling fluid used in the form of liquid or gas.

In FIG. 1 the compressor module is shown vertically oriented, but it can also be oriented horizontally. Furthermore, the connectors 9, 10 are only shown in diagrammatic form because their structural design and position, for example, whether they are vertical or horizontal, is irrelevant for the present invention. Nor it is of any importance whether the connectors are operated by divers or ROVs, or are remote-controlled.

The invention thus comprises both vertical and horizontal compressor modules and connectors under water.

Below there follows a description of the method for lowering and connecting the compressor module with nitrogen filling which prevents seawater from penetrating into the module, and the procedure for removing hydrocarbons from the module prior to disconnection and retrieval.

Prior to lowering, the compressor module is flushed with nitrogen until the oxygen content has practically been removed. The valves 7, 7' are then closed and the pipes 16, 14 can be used for flushing with nitrogen, for example, in that nitrogen is introduced through the pipe 16 and flows out through the pipe 14. During the lowering operation, it is important that the nitrogen pressure inside the module is always higher than the pressure of the surrounding seawater, so that a certain leakage in the shut-off valves 7, 7', 13, 15 results in nitrogen bubbling out into the sea rather than seawater penetrating into the module. It is in this connection most advantageous that the pipes 5, 6 are bent vertically and that the valves 7, 7' are vertical. If, notwithstanding the nitrogen overpressure, some seawater should enter the module, it is not especially detrimental until it reaches the level of the motor 1, but this can be prevented by the pressure of the gas padding in the motor.

Optionally, seawater that enters the module must, after the module has been installed and before it is put into operation, be drained out though the drainage pipe 12 by opening the valve 13. The valve is closed after the draining has been completed.

There are several ways of maintaining overpressure in relation to surrounding seawater during the lowering operation:

a. The module is pressurised on the deck of an installation vessel to a given overpressure, e.g., 1-5 bar, relative to the highest water pressure that module will be subjected to, i.e., the normal pressure at the seabed where the compressor station is installed.

b. The pressure in the module is adjusted continuously during the lowering operation so as to have a suitable overpressure relative to the surrounding seawater. This can be done in that:

a. the pipe 16 at the connection point 18 during the lowering is connected to a hose at the connection point 18 on the deck of the installation vessel, and via this hose the nitrogen pressure is continuously adjusted to a suitable level;

b. a ROV with nitrogen accumulator/nitrogen supply is connected to the pipe 16 and adjusts the pressure;

c. accumulators (tanks) of nitrogen are mounted on the module and connected to the pipe 16, and they are equipped with automatic control devices that adjust the pressure to a suitable level.

After the compressor module with the connectors 9, 10 has been connected to the compressor station, the valve 17 is closed and the nitrogen supply according to b.a. and b.b. is disconnected. The accumulator according to b.c. can remain in place. The compressor module is then put in operation according to certain procedures which are not covered by the present invention.

Before the module is to be retrieved, the valves 7, 7' are closed and production fluids, e.g., hydrocarbons, which may be in the module, are drained out via the drainage pipe 12 which is subsequently closed by the valve 13. The nitrogen supply (b) is connected to the pipe 16 via the connector 18 and the valve 17 is opened, as is also the valve 15. Nitrogen is then allowed to flow through the module in such amounts that it is ensured that the hydrocarbon content is below danger level as regards explosion potential and contamination when the module has been retrieved onto the deck. During the retrieval operation, both the valves 7, 7' and the valves 13, 14 are closed.

In the same way as for the lowering operation, the nitrogen pressure can be kept above the seawater pressure by either:

a. pressurising the module with nitrogen above the seawater pressure at the seabed and subsequently closing the valve 17 and disconnecting the nitrogen supply; or b. continuously adjusting the overpressure during the retrieval in the same way as b. during the lowering operation.

Below there follows a description of the method for lowering and connecting the compressor module with liquid filling that prevents seawater from penetrating into the module, and the procedure for removing production fluids, such as hydrocarbons, from the module before disconnection and retrieval. It is understood that both the nitrogen filling mentioned above and the liquid filling substantially prevent the penetration of seawater during the retrieval operation.

A necessary condition for this method is that a liquid is selected that does not corrode the materials in the interior of the module and in this connection takes into account in particular the stator of the motor which in a non-canned version is coated with a synthetic material.

For a known embodiment of this motor it has been established that the motor will stand being filled with deionised water, and also MEG or a mixture of these liquids.

Prior to lowering, the compressor module is filled with a filling liquid which is inert in relation to the interior of the compressor module. The valves 7, 7' are then closed and the liquid is filled through the pipe 16 until the liquid flows to overflow through the pipe 14 preferably at the highest point of the module. In practice, several filling and overflow pipes may be provided, as has been stated above, in order to ensure that the module is filled completely by the liquid supplied and is thus without any remaining air pockets.

Because the liquid with which the module is filled is incompressible, this method is well suited for preventing the influx of seawater. Should some seawater nevertheless enter the module during the lowering operation due to a leakage in shut-off valves, it is diluted to such a large extent by the liquid with which the module is filled that adverse effects can be eliminated.

As pressure and temperature change during the lowering operation from when the compressor module is on deck until it has reached the seabed, both the materials of which is built and its filling liquid will undergo a certain change in volume. It is therefore necessary that the module has some form of pressure and volume compensation, i.e., the pressure/volume compensator 19 with shut-off valve 20 as mentioned above.

The simplest form of pressure/volume compensation during lowering and retrieval is to pressure-compensate against the surroundings with a diaphragm/bellows device. Then the pressure inside the module will always be equal to the surrounding seawater pressure, likewise the air pressure when it is on deck. And even easier, this could simply be done by having a certain opening to the sea during the lowering operation, for example, by allowing the valve 17 to remain open. As mentioned, a small leakage of seawater inside the module is rendered harmless because of dilution.

A more advanced way is that the compensator 19, in addition to effecting pressure/volume compensation, is also in a known way designed to maintain the pressure inside the module at a given overpressure in relation to the surrounding sea water.

After the compressor module with the connectors 9, 10 has been connected to the compressor station, the liquid is drained out via the pipe 12 to a suitable point in the system, for example to the separator or scrubber upstream of the compressor module, as mentioned above, by opening the valve 13, similarly also the valve 15 which provides a "vent pipe function". The pipe 14 will in this case normally be connected to the gas side upstream of the compressor module, for example, to the pipe 5 or to an upper part of the scrubber. The compressor must then be mounted with a certain overheight relative to the liquid level in the scrubber in order to ensure certain drainage. Alternatively, the pipe 14 may during the drainage be connected to the outlet side of the compressor to ensure efficient drainage regardless of the location of the compressor module in relation to the liquid level in the separator due to the overpressure in the outlet pipe. For drainage it is also possible to connect the pipe 14 to an external source of compressed gas, for example, an accumulator mounted on the module.

After drainage the compressor will be started up following a predetermined procedure which is not described in more detail as such a procedure is outside the scope of the invention.

Before the module is to be retrieved, the valves 7, 7' are closed and any production fluids in the module are drained out via the drainage pipe 12 which is subsequently closed off by the valve 13. The module is then filled with the liquid in question in that the pipe 16, by means of the connector 18, is connected to an external supply source, for example a hose leading up to the vessel, a ROV or an accumulator. The module is filled until the filling liquid overflows through the pipe 14. As mentioned above, several filling and overflow pipes 16, 14 may in practice be provided in order to ensure that the module is completely filled with liquid and that no gas pockets remain. Thus, the module can be safely retrieved onto the deck of a vessel without any danger of explosion or contamination. During retrieval all shut-off valves 7, 7', 13, 15 and 17 are closed.

The same forms of pressure/volume compensation or overpressure control as discussed for lowering can be used during retrieval. As pointed out in the introduction, also seawater that may have entered the compressor module during installation despite appropriate measures can be drained out of the compressor module after it has been installed and before the start-up of operation in that the compressor module in a suitable way is again flushed with a filling medium in the form of either liquid or gas by appropriate use of the pipes for filling, drainage and overflow and associated valves.

The invention claimed is:

1. An apparatus for preventing seawater from penetrating into a compressor module during lowering to or retrieval from a compression plant on the seabed, wherein the compressor module comprises:

an electric motor (1) and a compressor (2) which are respectively connected via at least one shaft (8) and are arranged in a common pressure shell (3), an inlet pipe (5) and an outlet pipe (6) to and from the compressor module which respectively are provided with an isolation valve (7, 7'), at least one filling pipe (16) which has a shut-off valve (17), at least one drainage pipe (12) which has a shut-off valve (13) and is arranged to drain a lower end of the compressor module, and at least one overflow pipe (14) which has a shut-off valve (15), and which is spaced apart from the at least one filling pipe (16), wherein prior to lowering to or retrieval from the seabed, the compressor module is filled with filling fluid via the at least one filling pipe (16) until overflow of filling fluid through the at least one overflow pipe (14).

2. The apparatus according to claim 1, wherein prior to discharge of the production fluid from the compressor module, the shut-off valve (13) in the drainage pipe (12) is opened so that most the production fluid present can be drained out via the drainage pipe (12) before complete flushing and filling with filling liquid.

3. The apparatus according to claim 1, wherein the filling fluid is in the form of a gas or a liquid.

4. The apparatus according to claim 1, wherein prior to lowering, the pressure of the fluid supplied is increased to a suitable overpressure relative to the pressure at the seabed before closing the valves (15, 17) in the overflow pipe (14) and the filling pipe (16), respectively.

5. The apparatus according to claim 1, wherein when filling fluid in the form of a gas, the pressure in the compressor module is adjusted continuously during lowering or retrieval to a suitable overpressure relative to the surrounding seawater with the aid of the filling pipe (16) which, with open valve (17), is connected to an external supply source for gas at a pressure, the overpressure being continuously adjustable relative to the surrounding seawater, or as the module approaches or moves away from the compressor station on the seabed.

6. The apparatus according to claim 5, wherein the shut-off valve (17) is closed when the compressor module is connected to the compressor station on the seabed.

7. The apparatus according to claim 1, wherein when filling fluid in the form of a liquid, the compressor module is pressure/volume balanced during the lowering operation or retrieval with the aid of a diaphragm/bellows device (19).

8. The apparatus according to claim 1, wherein when filling fluid in the form of a liquid, the compressor module is pressure/volume balanced by using a direct connection to the seawater via the valve (17) in open position or other closable opening.

9. The apparatus according to claim 1, wherein prior to retrieval the compressor module is flushed with filling fluid supplied from an external source via the filling pipe (16) and outflow through the overflow pipe (14) with the respective valves (7, 7') closed, so that the content of any production fluid is reduced to below a potentially explosive level.

10. The apparatus according to claim 9, wherein during retrieval of the compressor module, the respective valves (7, 7', 13, 14) are closed, and pressure of the compressor module is adjusted to a suitable overpressure relative to the surrounding seawater by admission of filling fluid through the filling pipe (16) before closing the valve (17).

11. The apparatus according to claim 1, wherein after installation and prior to start-up, the compressor module is drained of any ingressed seawater by the through flow of filling fluid.

12. A method for preventing seawater from penetrating into a compressor module during lowering to or retrieval from a compression plant on the seabed, wherein the compressor module comprises an electric motor (1) and a compressor (2) which are respectively connected via at least one shaft (8) and are arranged in a common pressure shell (3), an inlet pipe (5) and an outlet pipe (6) to and from the compressor module which respectively are provided with an isolation valve (7, 7'), in the method comprising:

equipping the compressor module with at least one filling pipe (16) which has a shut-off valve (15), at least one drainage pipe (12) which has a shut-off valve (13), and which is located at a lower end of the compressor module, and at least one overflow pipe (14) which has a shut-off valve (17), and which is spaced apart from the at least one filling pipe (16), and prior to lowering to or retrieval from the seabed, filling the compressor module with filling fluid via the at least one filling pipe (16) until overflow of filling fluid through the at least one overflow pipe (14).

13. The method according to claim 12, wherein prior to discharge of the production fluid from the compressor module, opening the shut-off valve (13) in the drainage pipe (12) so that most of the production fluid present can be drained out via the drainage pipe (12) before complete flushing and filling with filling liquid.

14. The method according to claim 12, further comprising selecting the filling fluid in the form of a gas or a liquid.

15. The method according to claim 12, wherein prior to lowering, increasing the pressure of the fluid supplied to a suitable overpressure relative to the pressure at the seabed before closing the valves (15, 17) in the overflow pipe (14) and the filling pipe (16), respectively.

16. The method according to claim 12, wherein when filling fluid in the form of a gas, further comprising adjusting continuously the pressure in the compressor module during lowering or retrieval to a suitable overpressure relative to the surrounding seawater with the aid of the filling pipe (16) which, with open valve (17), is connected to an external supply source for gas at a pressure, the overpressure being continuously adjustable relative to the surrounding seawater, or as the module approaches or moves away from the compressor station on the seabed.

17. The method according to claim 16, further comprising keeping the shut-off valve (17) closed when the compressor module is connected to the compressor station on the seabed.

18. The method according to claim 12, wherein when filling fluid in the form of a liquid, pressure/volume balancing the compressor module during the lowering operation or retrieval with the aid of a diaphragm/bellows device (19).

19. The method according to claim 12, wherein when filling fluid in the form of a liquid, pressure/volume balancing the compressor module by using a direct connection to the seawater via the valve (17) in open position or other closable opening.

20. The method according to claim 12, wherein prior to retrieval, further comprising flushing the compressor module with filling fluid supplied from an external source via the filling pipe (16) and outflow through the overflow pipe (14) with the respective valves (7, 7') closed, so that the content of any production fluid is reduced to below a potentially explosive level.

21. The method according to claim 20, wherein during retrieval of the compressor module, closing the respective valves (7, 7', 13, 14), and adjusting its pressure to a suitable overpressure relative to the surrounding seawater by admission of filling fluid through the filling pipe (16) before closing the valve (17).

22. The method according to claim 21, wherein after installation and prior to start-up, further comprising draining the compressor module of any ingressed seawater by the through-flow of filling fluid.

* * * * *